US009631289B2

(12) United States Patent
Cayouette et al.

(10) Patent No.: US 9,631,289 B2
(45) Date of Patent: Apr. 25, 2017

(54) DRY CELL START-UP OF AN ELECTROLYTIC CELL FOR ALUMINUM PRODUCTION

(75) Inventors: Robert Cayouette, Chicoutimi (CA); François Laplante, Chicoutimi (CA)

(73) Assignee: Rio Tinto International Limited, Montreal (CA)

( * ) Notice: Subject to any disclaimer, the term of this patent is extended or adjusted under 35 U.S.C. 154(b) by 0 days.

(21) Appl. No.: 14/117,787

(22) PCT Filed: May 18, 2012

(86) PCT No.: PCT/CA2012/000474

§ 371 (c)(1),
(2), (4) Date: Nov. 14, 2013

(87) PCT Pub. No.: WO2012/174641

PCT Pub. Date: Dec. 27, 2012

(65) Prior Publication Data

US 2014/0076733 A1 Mar. 20, 2014

(30) Foreign Application Priority Data

May 25, 2011 (CA) ..... 2741112

(51) Int. Cl.
*C25C 3/06* (2006.01)
*C25C 7/06* (2006.01)

(52) U.S. Cl.
CPC . *C25C 3/06* (2013.01); *C25C 7/06* (2013.01)

(58) Field of Classification Search
CPC ..... C25C 3/06–3/24; C25C 7/06
See application file for complete search history.

(56) References Cited

U.S. PATENT DOCUMENTS 4,181,583 A * 1/1980 Steiger et al. ..... 205/396
4,919,782 A * 4/1990 Stewart ..... 204/247.3
5,006,209 A * 4/1991 Beck et al. ..... 205/336
(Continued)

FOREIGN PATENT DOCUMENTS

CN 101649469 A 2/2010
CN 101660174 A 3/2010
(Continued)

OTHER PUBLICATIONS

International Search Report and Written Opinion mailed Aug. 17, 2012 (PCT/CA2012/000474); ISA/CA.
(Continued)

*Primary Examiner* — Ciel Thomas
(74) *Attorney, Agent, or Firm* — Banner & Witcoff, Ltd.

(57) ABSTRACT

A method for starting up an electrolytic cell (20) for aluminum production having a cathode block (26) with an upper surface (32), the method comprising: disposing contact resistance material (46) over the upper surface (32) of the cathode block (26); lowering a plurality of anodes (28) to abut the contact resistance material (46); filling the electrolytic cell (20) and covering the anodes (28) with solid electrolyte material (72) comprising crushed electrolytic bath material, cryolite, or mixtures thereof; delivering electrical current to the anodes (28) to at least partially melt the solid electrolyte material (72) and raising the anodes (28) when a predetermined depth of molten electrolyte material has been reached.

20 Claims, 6 Drawing Sheets

(56) References Cited

U.S. PATENT DOCUMENTS

| | | | | |
|---|---|---|---|---|
| 6,338,785 | B1 | 1/2002 | de Nora et al. | |
| 7,485,215 | B2 | 2/2009 | Jouaffre et al. | |
| 2006/0131180 | A1 | 6/2006 | Jouaffre et al. | |
| 2007/0284259 | A1* | 12/2007 | MacLeod et al. | 205/390 |
| 2010/0294671 | A1* | 11/2010 | Nguyen et al. | 205/375 |

FOREIGN PATENT DOCUMENTS

| | | | |
|---|---|---|---|
| CN | 102041525 | A | 5/2011 |
| GB | 1046705 | A | 10/1966 |
| GB | 2062682 | A | 5/1981 |
| JP | 57-123990 | | 8/1982 |
| JP | 57123990 | A | 8/1982 |
| RU | 740866 | | 6/1980 |
| RU | 1420075 | | 8/1988 |

OTHER PUBLICATIONS

May 13, 2015—(EP) Extended Search Report—App 12802494.
Apr. 1, 2016—(CN) Office Action—App 2012800250951.

* cited by examiner

DRY CELL START-UP OF AN ELECTROLYTIC CELL FOR ALUMINUM PRODUCTION

CROSS-REFERENCES TO RELATED APPLICATIONS

The present application is a U.S. National Phase filing of International Application No. PCT/CA2012/000474, filed on May 18, 2012, designating the United States of America and claiming priority to Canadian Patent Application No. 2741112, filed May 25, 2011, and this application claims priority to and the benefit of the above-identified applications, which are both incorporated by reference herein in their entireties.

TECHNICAL FIELD

The technical field relates to the start-up of an electrolytic cell for producing aluminum, when starting up a new electrolytic cell which has never been in operation or after a shut-down and restart or a refurbishment of an electrolytic cell.

BACKGROUND

During operation of an electrolytic cell for aluminum production, the cathode block becomes damaged and will need to be replaced. This is a normal procedure which will typically take place after several years of operation. During rebuilding of an electrolytic cell which may typically take up to about one month and significant resources, the electrolytic cell is out of production. Regardless of the reason for the start-up of a cell, whether a rebuild or a new cell start-up, it is of interest to minimize the impact of any down time and to put a cell into operation as soon as possible.

Prior to putting an electrolytic cell into operation, the cathode block must be pre-heated, typically to a temperature of from about 800 to 900° C. This may be done in various ways, including for example, applying a granular conductive material like coke or graphite in rounds on the surface of the cathode beneath the anodes and applying power to the anodes to thereby transmit electrical current to the cathode block. The granular conductive material applied between the cathode and the anodes is often referred to as a contact resistance material. Coke or graphite may be selected to obtain the desired electrical resistance of a contact material so as to deliver more or less heat to the electrolytic cell.

In U.S. Pat. No. 7,485,215, a process is described in which the periphery of the electrolytic cell is filled with crushed electrolyte bath material and sodium carbonate. In addition, rock wool is applied against the upper surface and the outer surfaces of the anodes as well as over the central corridor of the electrolytic cell in order to minimize heat losses from the electrolytic cell during pre-heating of the cathode block. The electrolytic cell is then energized so as to cause an electric current to flow between the anodes and the cathode block.

Once the cathode is pre-heated, which may take place over a period of 36 to 48 hours, sufficient molten bath taken from other so-called donor cells which are in operation, is added to the electrolytic cell for immersing the anodes and to raise the anodes to operational levels without creating any open electrical circuits. Molten bath obtained from donor cells is normally used despite the disturbances arising from having to melt crushed bath from donor cells. However, this is not always an option, particularly in "Greenfield" operations where donor cells are unavailable at least until some electrolytic cells are put into operation. The molten electrolyte bath becomes the conductor material between the anode and the cathode so the heat up phase continues up to fourteen to thirty two hours and finally, after that heat-up phase is complete, molten aluminum metal is added to cover the cathode surface beneath the molten electrolyte bath. At this stage, a solid crust is formed on top of the bath and the anodes may be covered with the usual additions of alumina, solid granulated bath, and additives such as AlF3 and calcium to thermally isolate the cell. Normal operation can begin with an optimal heat balance of the cell giving the opportunity to reduce energy input.

In such a traditional cell start-up, five to twelve tons of molten electrolyte bath from about ten donor cells are required, depending on the size of the electrolytic cell. This is a very labor-intensive operation which not only is time consuming but also monopolizes use of the crane to siphon and transport molten electrolyte bath from donor cells to the start-up cell. This can be a problem in an operating plant where the same crane is also needed to siphon metal and for regular anode changing operations. In addition to the labor involved with liquid bath transportation, more care is required to maintain the donor cells in operation which is particularly challenging when starting up a "Greenfield" operation.

Previously, in some "Greenfield" operations, attempts were made to start-up a new cell by applying a thin layer of cryolite to the upper surface of the cathode block around the coke up to a height of about 5 to 10 centimeters (1.97 to 3.94 inches), in order to insulate the area surrounding the anodes and to direct the heat generated from the coke towards the cathode block. These early attempts at dry cell start-ups were fraught with problems and were subsequently abandoned by the aluminum smelting community. As soon as any molten pools of cryolite would form, the molten material would settle in low areas of the cathode and subsequently freeze if the underlying cathode surface was not sufficiently preheated. Severe start-up problems would occur if the molten cryolite had settled beneath an anode, thereby electrically insulating the cathode and causing the anode to short-circuit. The resulting current distribution in the cell became so electrically unstable that aluminum refineries resorted to such dry start-up procedures only when absolutely necessary and only with the support of an expert team of operators and management personnel.

SUMMARY

According to a general aspect, there is provided a method for starting up an electrolytic cell for aluminum production, the electrolytic cell having a cathode block with an upper surface, the method comprising: disposing contact resistance material on said upper surface of the cathode block; lowering a plurality of anodes to abut the contact resistance material; filling the electrolytic cell to a height covering the anodes with solid electrolyte material, the solid electrolyte material comprising crushed electrolytic bath material, cryolite, or mixtures thereof; delivering electrical current to the anodes to at least partially melt the solid electrolyte material; and raising the anodes when a predetermined depth of molten electrolyte material has been reached.

BRIEF DESCRIPTION OF THE DRAWINGS

It will be noted that throughout the appended drawings, like features are identified by like reference numerals.

DETAILED DESCRIPTION

Figure 1:
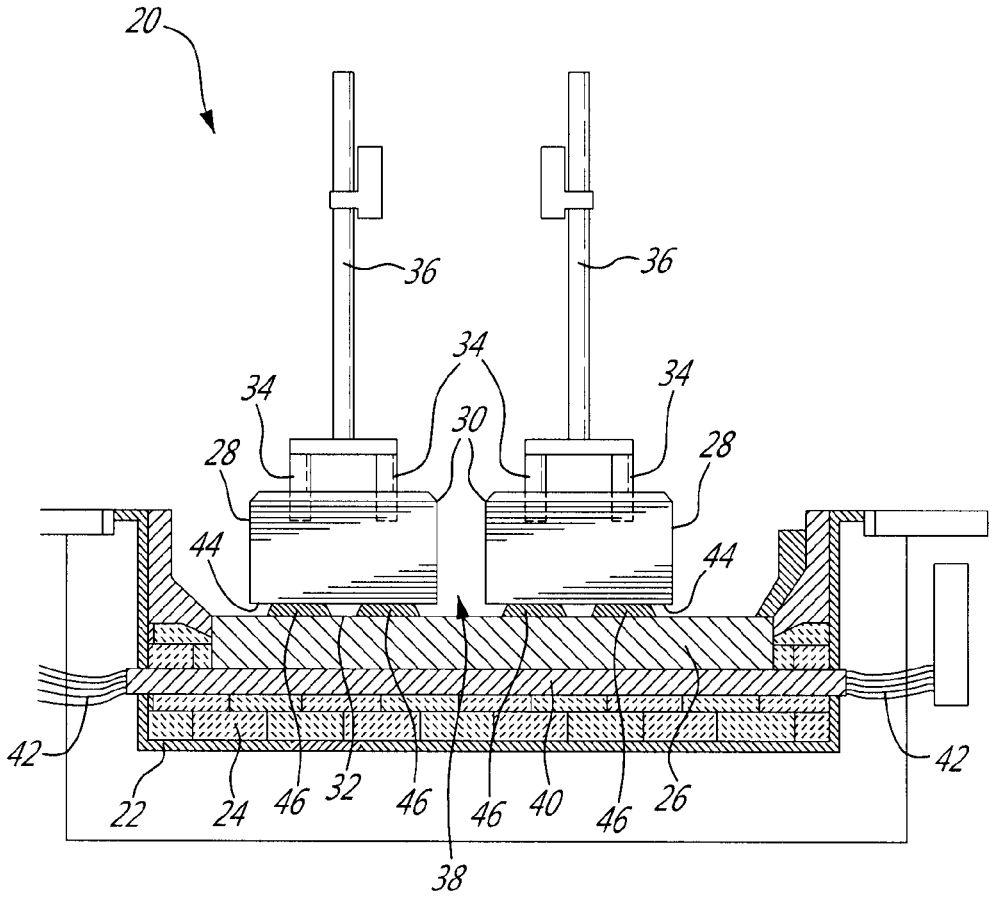
FIG. 1 is a schematic cross-sectional view of an electrolytic cell after contact resistance material has been deposited on a cathode surface and the anodes have been lowered so that the contact resistance material lies therebetween.

Referring now to the drawings and, more particularly, referring to FIG. 1, there is shown an electrolytic cell 20 for aluminum production. The cell 20 has an outer shell 22 containing an internal lining 24 and a cathode block 26 located in the bottom of the cell 20. Anodes 28 are shown having an upper surface 30 and an opposed lower surface 44 (or contact surface).

Generally, the outer shell 22 is made of metal such as steel, the internal lining 24 generally includes blocks of refractory material, refractory lining paste and/or solidified bath, the cathode block 26 is a carbothermic cathode block, and the anodes 28 are made of carbonaceous material.

The anodes 28 are connected to an anode beam (not shown) through multipodes terminating in a plurality of anode studs 34, anode stems 36, and an anode frame (not shown). The anode frame is adapted to lower and raise the anodes 28 within the electrolytic cell 20.

Either for pre-heating the electrolytic cell 20 or during electrolysis, an electrical current flows through the aluminum electrolytic cell 20. The electrical current enters the cell 20 through the anodes 28 via the anode beam, the anode frame, the anode stems 36, and the attachment means including the anode studs 34. The electrical current then enters the cathode block 26 and is carried out of the cell 20 by current collector bars 40. The current collector bars 40 are typically made of steel and electrical conductors 42 are attached thereto to route the electrolysis current.

To start-up an electrolytic cell, the electrolytic cell 20 must be pre-heated. For pre-heating the electrolytic cell 20, a discontinuous layer of a granular contact resistance material 46 is deposited on an upper surface 32 of the cathode block 26. The granular contact resistance material 46 is deposited in contact surface areas at predetermined positions on said upper surface 32 of the cathode block 26. The contact resistance material 46 is placed in a discontinuous way on the cathode surface. These contact surface areas of contact resistance material 46 can be of different sizes and shapes. Furthermore, the number of contact surface areas can vary. The anodes 28 are then lowered onto the contact resistance material 46 so as to make intimate contact with the granular contact resistance material.

By way of example, graphite and/or coke can be used as contact resistance material 46 interposed between the lower surface 44 of the anodes 28 and the upper surface 32 of the cathode block 26. In an embodiment, the contact resistance material contains up to 100% coke, the remainder being essentially graphite. In another embodiment, the contact resistance material contains up to 70% coke and the remainder being essentially graphite. In another embodiment, the contact resistance material contains up to 50% coke and the remainder being essentially graphite. In a further embodiment, the contact resistance material contains up to 30% coke, the remainder being essentially graphite. The following table shows examples of contact resistance materials which may be used with the present method:

TABLE 1

| Pot # | Amperage | Start-up Voltage | Contact resistance material composition | Contact resistance material circumference | Kilowatt |
|---|---|---|---|---|---|
| Dry start up | | | | | |
| 4058 | 358 | 5.5 | Coke | 160 mm (6.3 inches) | 1969 |
| 2038 | 362 | 5.6 | Coke | 160 mm (6.3 inches) | 2027 |
| 2136 | 358 | 5.2 | Coke | 160 mm (6.3 inches) | 1862 |
| 3015 | 386 | 5.73 | Coke | 200 mm (7.87 inches) | 2212 |
| 1036 | 372 | 5.12 | Coke | 160 mm (6.3 inches) | 1905 |
| 1033 | 370 | 5.7 | Coke | 160 mm (6.3 inches) | 2109 |
| 1034 | 370 | 5.74 | Coke | 160 mm (6.3 inches) | 2124 |
| 1017 | 370 | 5.54 | Coke | 160 mm (6.3 inches) | 2050 |
| 1035 | 369 | 5.09 | Coke | 160 mm (6.3 inches) | 1878 |
| 3011 | 387 | 5.27 | 70% coke - 30% graphite | 160 mm (6.3 inches) | 2039 |
| 2142 | 369 | 5.9 | Coke | 160 mm (6.3 inches) | 2177 |
| 1099 | 369 | 5.08 | 70% coke - 30% graphite | 160 mm (6.3 inches) | 1875 |
| 4069 | 378 | 5.5 | 70% coke - 30% graphite | 160 mm (6.3 inches) | 2079 |
| 4002 | 378 | 4.72 | 50% coke - 50% graphite | 160 mm (6.3 inches) | 1784 |
| 3048 | 380 | 5.2 | 50% Coke - 50% graphite | 160 mm (6.3 inches) | 1976 |
| 4036 | 380 | 5.2 | 30% Coke - 70% graphite | 160 mm (6.3 inches) | 1976 |
| Liquid Start-up (conventional) | | | | | |
| 2122 | 365 | 3.1 | graphite | 160 mm (6.3 inches) | 1132 |
| 2002 | 365 | 3.25 | graphite | 160 mm (6.3 inches) | 1186 |
| 3007 | 385 | 3.28 | graphite | 200 mm (7.87 inches) | 1263 |
| 3009 | 385 | 3.17 | graphite | 200 mm (7.87 inches) | 1220 |
| 3010 | 385 | 3.35 | graphite | 200 mm (7.87 inches) | 1290 |
| 3012 | 385 | 3.21 | graphite | 200 mm (7.87 inches) | 1236 |
| 3018 | 385 | 3.12 | graphite | 200 mm (7.87 inches) | 1201 |

When the electrolytic cell 20 is energized, electric current flows between the anodes 28 and the cathode block 26 through the contact resistance material 46.

Figure 2:
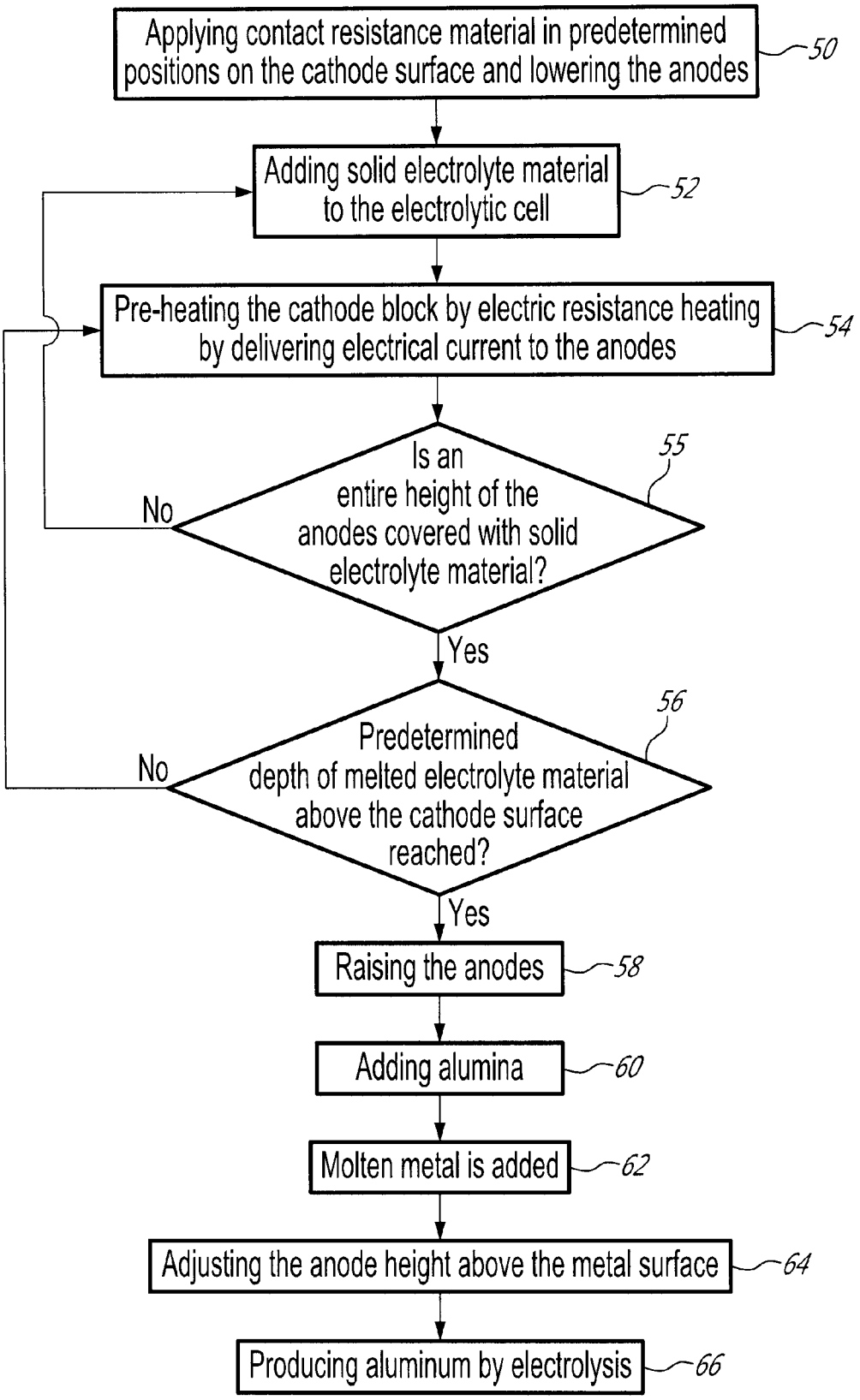
FIG. 2 is a flowchart showing sequential steps for starting-up the dry electrolytic cell.

Referring now to FIG. 2, there is shown a flowchart showing sequential steps for starting-up a dry electrolysis cell. The first step 50 includes the application of the contact resistance material 46 on the upper surface 32 of the cathode block 26 and lowering the anodes 28 as described above.

Figure 3:
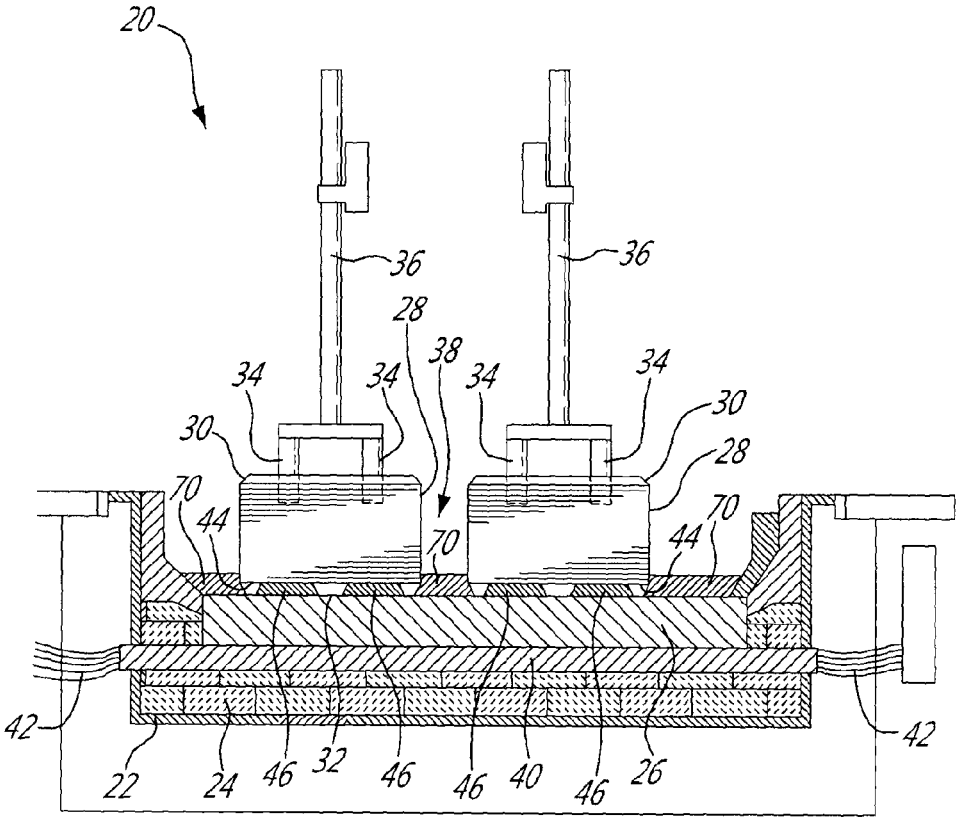
FIG. 3 is a schematic cross-sectional view of the electrolytic cell after a first layer of solid electrolyte material has been deposited over the cathode block around the anodes.
Figure 4:
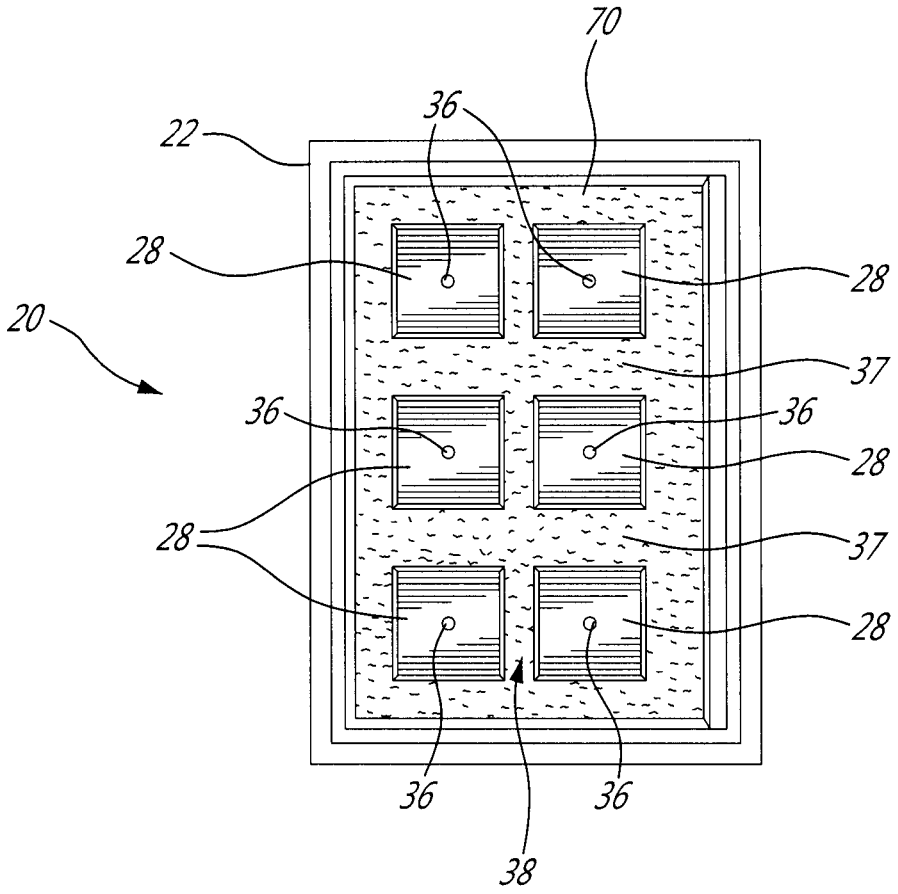
FIG. 4 is a plan view of the electrolytic cell of FIG. 3.

Then, in step 52, solid electrolyte material, which can be cryolite ($Na_3AlF_6$), crushed solid electrolyte bath material previously recovered from an operating electrolytic cell, or a combination thereof, including any desired additives such as $AlF_3$, is applied around the anodes 28 and over the upper surface 32 of the cathode block 26. As shown in FIG. 3, an initial or first layer 70 of solid electrolyte material 72 (FIG. 5) surrounds the anodes 28 but is not provided under the contact surface 44 of the anodes 28. The solid electrolyte material surrounds the periphery of the anodes 28 and covers the cathode upper surface 32, including the lateral corridors 37 (FIG. 4) defined between adjacent rows of anodes 28 and a central corridor 38 (FIG. 4). The distribution of solid electrolyte material on the cathode surface is best shown in the plan view of FIG. 4.

Figure 5:
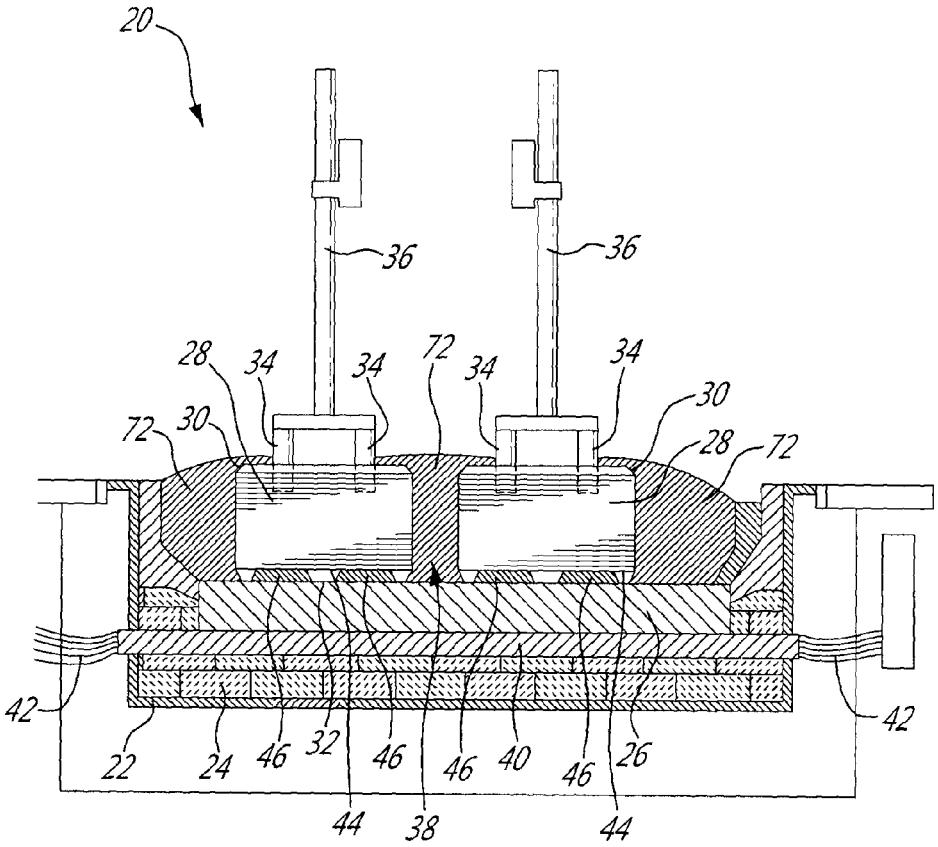
FIG. 5 is a schematic cross-sectional view of the electrolytic cell filled with solid electrolyte material covering the entire height of the anodes.

Either cryolite, crushed electrolyte bath material, or a combination thereof, referred in this application as solid electrolyte material, may be used to fill the entire depth of the electrolytic cell 20 and to cover the upper surface 30 of the anodes 28 as shown in FIG. 5. The solid electrolyte material 72 is characterized by, amongst others, a particle size distribution, a liquidus, a solidus and a melting point or melting range, i.e. the temperature difference between the solidus and liquidus temperatures. The solid electrolyte material 72 is selected with a combination of particle size distribution, solidus, liquidus and melting range which minimizes resolidification of melted electrolyte material during the start-up procedure and whose chemical composition is selected to minimize the melting temperature range and the solid fraction remaining once melting has begun. The melting temperature range of the solid electrolyte material is preferably from about 825 to about 950° C. Resolidification can occur when the melted material rises in the electrolytic cell 20 through crushed electrolyte bath material by capillarity and solidifies due to lower temperatures in upper zones of the electrolytic cell 20. If the particle size distribution is relatively coarse, heat losses in the electrolytic cell 20 during the start-up procedure are increased. On the other hand, if the particle size distribution is relatively fine, melted material can rise in the electrolytic cell 20 through the crushed material by capillarity. The solid electrolyte material preferably has the following particle size characteristics: a maximum particle size of about 15 mm (0.6 inches), less than about 10 wt% of the solid electrolyte material has a particle size of about 6 mm (0.24 inches) or more and less than about 30 wt% of the solid electrolyte material has a particle size of about 45 microns (0.002 inches) or less. Crushed material having higher liquidus and solidus requires more energy to melt while crushed material having a larger melting range can more easily resolidify. As mentioned above, the solid electrolyte material may contain cryolite with crushed electrolyte bath material. Preferably, the solid electrolyte material may contain a total $Al_2O_3$ content of about 12 wt% or less and an alpha $Al_2O_3$ content of about 8wt% or less. Having too much $Al_2O_3$ in the solid electrolyte material could cause the $Al_2O_3$ to settle at the bottom of the cell thereby insulating the cathode and overall decreasing the efficiency of the start-up method. The following table shows preferred ranges for the content of the solid electrolyte material as well as an example of a specific composition (column Example %):

TABLE 2

| Solid electrolyte material content | Example % | Preferred ranges |
|---|---|---|
| $Na_3AlF_6$ | 77.3 | >74.0% min. |
| Excess $AlF_3$ | 11.3 | <13.5% max. |
| $CaF_2$ | 5.9 | <6.5% max. |
| $Al_2O_3$ alpha | 2.5 | <6.0% max. |
| $Al_2O_3$ Total | 5.0 | <10% |
| C | 0.20 | <0.30% max. |
| $MgF_2$ | 0.28 | <0.50% max. |
| $Fe_2O_3$ | 0.05 | <0.17% max. |
| $SiO_2$ | 0.06 | <0.17% max. |
| $P_2O_5$ | 0.01 | <0.04% max. |
| LOI at 100 C. | 0.1 | <0.6% max. |
| Sulfur (S) | 0.1 | <0.2% |
| Beryllium | 0.01 | <0.02% max. |
| RATIO | 1.09 | 1.04 to 1.14 |

In table 2, LOI refers to Loss of Ignition which is an indication of the moisture content. Ratio refers to the cryolithic ratio.

To complete the start-up procedure, solid electrolyte material 72 may be added to extend generally above the upper surface 30 of the anodes 28, opposed to the contact surface 44 to lower heat losses and prevent solidification of any liquefied electrolyte material, as indicated in step 55 and shown in FIG. 5. In other words, the electrolytic cell 20 is filled with solid electrolyte material 72 and the upper surface 30 of the anode 28 is covered by the solid electrolyte material 72. Usually, a crust would have formed on top of first layer 70. As such, solid electrolyte material 72 would have to be added by breaking the crust on top of first layer 70. In an embodiment, the solid electrolyte material 72 at least partially covers the multipodes or studs 34, i.e. the attachment elements that are anchored to the anode blocks 28 and that extend between the anode stems 36 and the anode blocks 28. In an embodiment, only the upper surfaces of the studs 34 are not covered by the solid electrolyte material 72. Covering the upper surface 30 of the anodes 28 and at least partially the studs 34 lowers the heat losses during the start-up procedure and minimizes resolidification of the liquefied electrolyte material. Thus, the depth of solid electrolyte material extending above the upper surface 30 of the anode 28 is variable.

In an embodiment, the solid electrolyte material 72 can be added to the electrolytic cell 20 in more than one step as indicated by step 55. Again, a crust would have usually formed on top of the solid electrolyte material 72. Additional solid electrolyte material is added by breaking this crust and pushing the additional solid electrolyte material into the melted electrolyte. In an embodiment, this operation is carried out periodically every hour until the entire height of the anodes is covered with electrolyte.

In step 54, the electrolytic cell 20 is energized and electrical current is delivered to the anodes 28. The cathode block 26 is heated by electric resistance heating by electrical current delivered to the anodes 28.

The solid electrolyte material 72 close to or adjacent to the cathode block 26 melts as energy is provided to the electrolytic cell 20. The depth of melted electrolyte material close to the cathode block 26 is monitored as shown in step 56. When a predetermined depth of electrolyte is melted, the anodes 28 may be raised as shown in step 58. In an embodiment, for an electrolytic cell having typical dimensions, the anodes 28 are raised when the melted electrolyte material reaches a depth of at least about 30 centimeters (11.81 inches) above the cathode block 26. The depth of the melted material can be measured every two to three hours during the start-up procedure. Then, the anodes 28 are raised gradually until the contact surfaces 44 of the anodes 28 reach a predetermined distance above the upper surface 32 of the cathode block 26. Subsequently, as shown in step 60, alumina is added to control anode effects. The alumina may be added between 2 to 5 hours after raising the anodes.

In step 62, molten aluminum metal is added to stabilize the cell and avoid over-heating. In step 64, the distance separating the anodes 28 from the aluminum metal surface is adjusted to stabilize the electrolytic cell 20 and, in step 66, the electrolytic cell 20 is operated in a normal manner to produce aluminum by electrolysis.

Referring again to FIGS. 3 and 4, it will be shown that alternatives are foreseen for carrying out steps 52 and 54. For instance and without being limitative, the solid electrolyte material 72 can be added before, during, or after preheating of the cathode block 26.

In the embodiment described above, the solid electrolyte material 72 is added to the electrolytic cell 20 and covers the entire height of the anodes 28 before the electrolytic cell 20 is energized. Thus, before the electrolytic cell 20 is energized, solid electrolyte material 72 is added around the anodes 28 until it at least covers the upper surface 30 of the anodes 28 as shown in FIG. 5.

In an alternative embodiment, the electrolytic cell 20 is energized after the contact resistance material 46 is disposed on the cathode block 26. Before the cathode block 26 overheats, the electrolytic cell 20 is at least partially filled with the solid electrolyte material 72 as will be described in more detail below. The electrolytic cell 20 can be filled in a single step while in an alternative embodiment, one or more successive layers of solid electrolyte material 72 can be loaded in the electrolytic cell 20 until the upper surfaces 30 of the anodes 28 are covered with solid electrolyte material as shown in FIG. 5.

In still another embodiment, the electrolytic cell 20 is energized after the contact resistance material 46 is disposed on the cathode block 26 and a first layer 70 of solid electrolyte material 72 has been loaded into the cell which does not reach the upper surfaces 30 of the anodes 28, as shown in FIG. 3. Additional layer(s) of solid electrolyte material are added after the electrolytic cell 20 is energized until the upper surfaces 30 of the anodes 28 are covered with solid electrolyte material 72.

As will be described in more detail below with reference to FIG. 6, the upper surfaces 30 of the anodes 28 should be covered with solid electrolyte material before the material begins to melt (typically between 18 to 20 hours after initiating the cathode heating process) and the voltage of the electrolytic cell 20 begins to drop. This is done as a preventive action to avoid partial re- solidification of molten bath or cryolite and to ensure that enough heat will be kept in the cell to sustain melting of electrolyte material. When the electrolyte material begins to melt, the voltage in the cell drops because the molten electrolyte material has a greater conductivity than the contact resistance material 46 and the total energy input to the cell is reduced. Such a reduced voltage may potentially be insufficient to maintain the heat required to maintain electrolyte material in a molten state.

Now referring to FIG. 3, there is shown one embodiment in which a first layer 70 of solid electrolyte material 72 is loaded in the electrolytic cell 20. The first layer 70 of solid electrolyte material surrounds the anode blocks 28 and covers the entire surface of the cathode block 26 with the exception of the cathode surface 32 located below the anode blocks 28 and which surrounds the contact resistance material 46. The first layer 70 can be disposed after the electrolytic cell 20 has been energized or before energizing the electrolytic cell 20.

In the embodiment shown, the first layer 70 extends slightly above the contact surface 44 of the anode blocks 28. However, one skilled in the art will appreciate that the height of the first layer can vary from the embodiment shown in FIG. 3. In an embodiment, the first layer 70 has a thickness of about 5 cm (1.97 inches) and is added twelve hours after the beginning of the pre- heating procedure.

Figure 6:
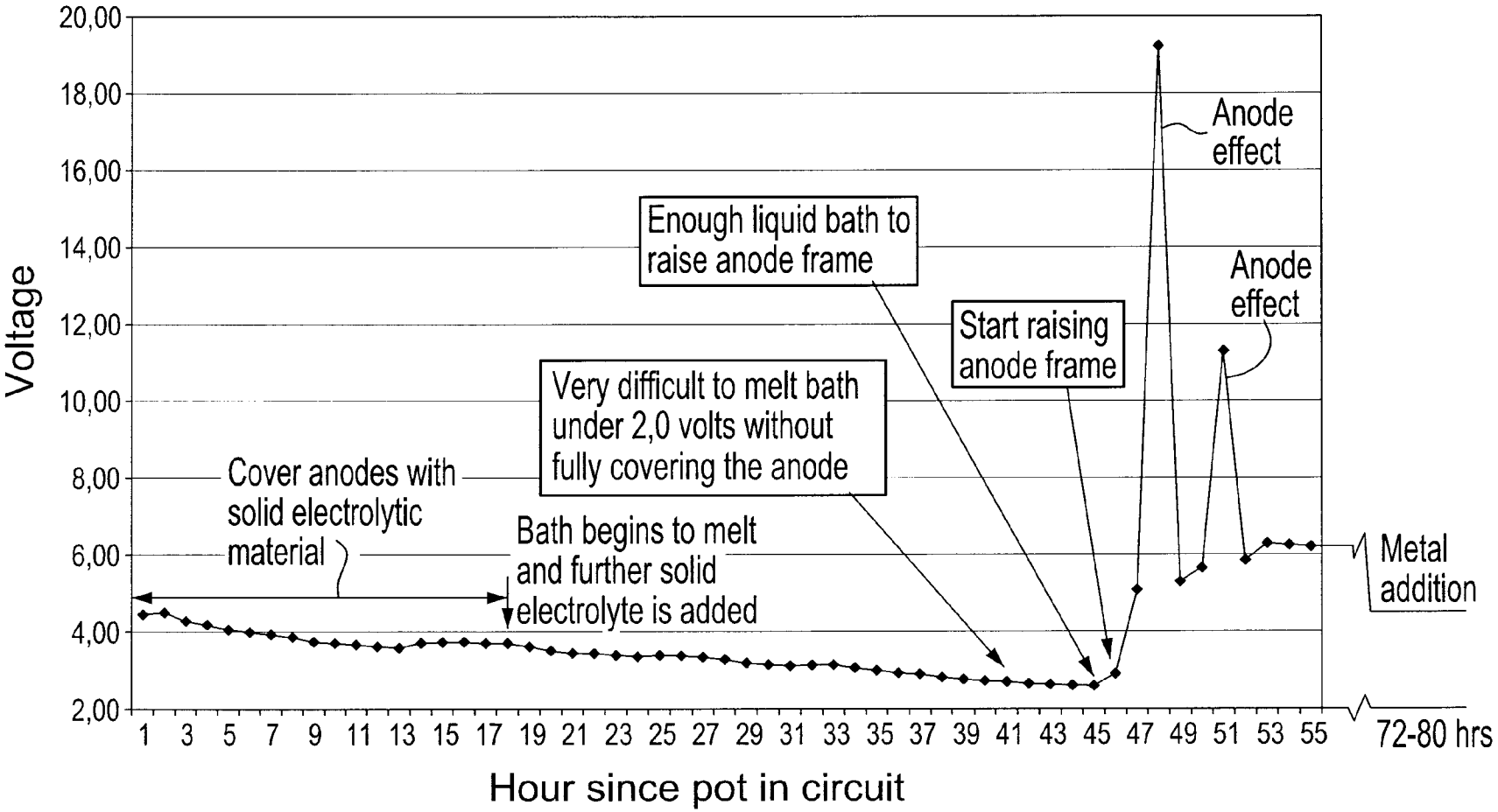
FIG. 6 is a graph showing a voltage drop which occurs during a dry cell start-up after electrolyte material begins to melt.

Following addition of the first layer 70 of solid electrolyte material, the electrolytic cell 20 is energized (or further energized) and, before the cell voltage drops as shown in FIG. 6, an additional layer of solid electrolyte material 72 is added to the electrolytic cell 20. The additional layer of solid electrolyte material can extend above the upper surfaces 30 of the anodes 28, as shown in FIG. 5, or anywhere above the first layer 70. In other words, the height of the additional layer(s) is(are) variable.

If the additional layer of solid electrolyte material does not extend above the upper surfaces 30 of the anode blocks 28, additional layer(s) of solid electrolyte material is/are added until the solid electrolyte material extends above the upper surfaces 30 of the anodes 28.

As shown in FIG. 5, the solid electrolyte material 72 at least partially covers the anode studs 34 to reduce heat loss during the start-up procedure. One skilled in the art will appreciate that the final height of the solid electrolyte material 72 is variable. Heat losses are reduced by increasing the total depth of the solid electrolyte material.

The thickness of the layer of solid electrolyte material to be added into the electrolytic cell is selected to maintain heat losses to an acceptable level and, thus, avoid re-solidification. According to some applications, it may not be necessary to fully embed the anodes 28 into the solid electrolyte material. For instance, the solid electrolyte material could extend to a height which is slightly less than that of the top surface 30 of the anodes 28 and still provide sufficient insulation.

As mentioned above, one skilled in the art will appreciate that the electrolytic cell 20 can be filled with solid electrolyte material, wherein the solid electrolyte material covers the entire height of the anodes 28 and extends above their upper surface 30, before energizing the electrolytic cell 20, as shown in FIG.

5.

If crushed solid electrolyte bath material is used instead of cryolite for the dry start up procedure, sodium carbonate can be added to the cell. The composition of the solid electrolyte material was discussed above.

With the dry cell start-up method described above, using crushed electrolytic bath or cryolite to immerse the anodes 28, the cathode block 26 is pre-heated for a period of about eighteen hours after which there is a gradual melting of the electrolytic bath or the cryolite that takes place over a period of about thirty hours. When sufficient electrolytic bath or cryolite is in the liquid state and the molten layer has reached a depth of about 30 to 35 centimeters (11.81 to 13.78 inches), the anodes 28 may be raised gradually. When the anodes are initially lifted away from the contact resistance material 46, by a distance of about 5 cm, a molten pool enters the space separating the anodes from the cathode, thereby increasing the voltage drop between the anodes and the cathode because of increased resistance resulting from a combination of the molten electrolyte resistivity and the distance separating the anodes from the cathode. Since the anodes occupy a large volume, the depth of molten electrolyte material in the cell may decrease from about 30 cm (11.81 inches) to about 15 cm (5.91 inches) above the cathode surface. Accordingly, sufficient molten electrolyte material must be present to allow the anodes to be raised in order to maintain a minimum voltage required to continue to heat the cell and to melt the insulating cover of solid electrolyte material. If the anodes cannot be raised high enough in the molten pool to maintain voltage, there is a risk that the cell might cool down and some of the previously molten electrolyte material could freeze. Once the cathode temperature gradient is reached, about 24 to 32 hours later, molten metal is added to the electrolytic cell 20 to stabilize the cell and avoid over-heating. The anodes are then raised by a distance corresponding to about the additional height of the molten metal in the cell and regular operation may begin with alumina being fed to the operating cell to produce metal by electrolysis.

Advantageously, the above-described method allows one to more than double the number of electrolytic cells 20 that may be started up for a given period. These advantages result from reducing the work load for the crane which is normally the bottle neck for speeding up a smelter start-up process. The above method contributes to improve the safety and reliability of the start- up operation, while minimizing the start-up time of a cell.

Once the electrolytic bath or the cryolite begins to melt, the electrolytic bath or the cryolite melts in a more controlled manner so that the anodes 28 may be raised with minimal disruption to the current distribution in the electrolytic cell 20.

For the dry start-up procedure, one skilled in the art will appreciate that the anode stems 36 can be connected to the anode frame with flexible or roller assemblies as is known in the art in order to adjust the distance separating a single or several anodes 28 from the cathode block 26 according to the amperage being drawn by the selected anode, particularly where there are local hot spots.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A method for starting up an electrolytic cell for aluminum production, the electrolytic cell having a cathode block with an upper surface, the method comprising:

disposing contact resistance material on said upper surface of the cathode block;

lowering a plurality of anodes to abut the contact resistance material, wherein the plurality of anodes are carbonaceous anodes each having a bottom surface confronting the cathode block, an upper surface opposite the bottom surface, and side walls extending upward from the cathode block to the upper surface, such that the upper surface extends inwardly from the side walls;

filling the electrolytic cell to a height covering the upper surface of each of the plurality of anodes with solid electrolyte material, the solid electrolyte material comprising crushed electrolytic bath material, cryolite, or mixtures thereof;

delivering electrical current to the plurality of anodes to at least partially melt the solid electrolyte material; and raising the plurality of anodes away from the cathode block when a predetermined depth of molten electrolyte material has been reached, wherein filling the electrolytic cell with the solid electrolyte material comprises providing sufficient solid electrolyte material so that when the plurality of anodes are raised, enough solid electrolyte material has melted to maintain a minimum voltage required to continue to heat the electrolytic cell.

2. A method as claimed in claim 1, wherein the contact resistance material is discontinuously disposed at predetermined positions on said upper surface of the cathode block.

3. A method as claimed in claim 1, wherein the plurality of anodes are raised until the plurality of anodes reach a pre-determined height above the upper surface of the cathode block.

4. A method as claimed in claim 1, wherein the electrolytic cell is filled with the solid electrolyte material and the plurality of anodes are covered by the solid electrolyte material before current is delivered to the cell.

5. A method as claimed in claim 1, wherein the electrolytic cell is filled with the solid electrolyte material and the plurality of anodes are covered by the solid electrolyte material after delivering electrical current to the plurality of anodes.

6. A method as claimed in claim 1, wherein the electrolytic cell is filled in at least two filling steps and the electrical current is continuously delivered to the plurality of anodes following a first energization of the electrolytic cell.

7. A method as claimed in claim 1, wherein the contact resistance material comprises crushed coke material, crushed graphite material or mixtures thereof.

8. A method as claimed in claim 1, wherein the solid electrolyte material contains a total $Al_2O_3$ content of about 2% or less and an alpha $Al_2O_3$ content of about 8% or less.

9. A method as claimed in claim 1, wherein the solid electrolyte material has a maximum particle size of about 15 mm (0.6 inches), less than about 10 % of the solid electrolyte material has a particle size of about 6mm (0.24inches) or more, and less than about 30% of the solid electrolyte material has a particle size of about 45 microns (0.002 inches) or less.

10. A method as claimed in claim 1, wherein the predetermined depth of molten electrolyte material reached before raising the plurality of anodes is at least thirty centimeters (11.81 inches).

11. A method as claimed in claim 1, further comprising:

adding alumina to the electrolytic cell;

adding molten metal proximate to the upper surface of the cathode block following raising the plurality of anodes; and adjusting a distance separating a lower surface of each of the plurality of anodes from an upper surface of a layer of the molten metal to stabilize the electrolytic cell.

12. A method as claimed in claim 1, wherein electrical current is delivered to the electrolytic cell before the electrolytic cell is at least partially filled with the solid electrolyte material.

13. A method as claimed in claim 1, wherein filling the electrolytic cell comprises entirely burying the plurality of anodes within the solid electrolyte material, the solid electrolyte material fully covering the upper surface of the plurality of anodes when lowered in abutment relationship with the contact resistance material disposed on the upper surface of the cathode block.

14. A method as claimed in claim 1, wherein anode studs project from respective upper surfaces of the plurality of anodes, and wherein filling the electrolytic cell comprises adding solid electrolyte material to extend above the upper surfaces of the plurality of anodes such that the anode studs are at least partly buried in the solid electrolyte material when the plurality of anodes are lowered in intimate contact with the contact resistance material.

15. A method as defined in claim 1, further comprising monitoring the voltage of the electrolytic cell, and wherein filling the electrolytic cell comprises covering an upper surface of each of the plurality of anodes with the solid electrolytic material before the voltage drops below a predetermined value.

16. A method as defined in claim 1, wherein enough of the solid electrolyte material has melted in the electrolytic cell to allow the plurality of anodes to be raised without the addition of any molten electrolyte material from a donor cell.

17. A method as defined in claim 1, comprising entirely burying the plurality of anodes within the solid electrolyte material before the solid electrolyte material begins to melt.

18. A method as claimed in claim 1, wherein the solid electrolyte material covers an entire height of each of the plurality of anodes.

19. A method for starting up an electrolytic cell for aluminum production, the electrolytic cell having a cathode block with an upper surface, the method comprising:

disposing contact resistance material on said upper surface of the cathode block;

lowering a plurality of anodes to abut the contact resistance material, wherein the plurality of anodes are carbonaceous anodes;

filling the electrolytic cell to a height covering an upper surface of each of the plurality of anodes with solid electrolyte material, the solid electrolyte material comprising crushed electrolytic bath material, cryolite, or mixtures thereof, wherein filling the electrolytic cell comprises entirely burying the plurality of anodes within the solid electrolyte material, the solid electrolyte material fully covering the upper surface of the plurality of anodes when lowered in abutment relationship with the contact resistance material disposed on the upper surface of the cathode block;

delivering electrical current to the plurality of anodes to at least partially melt the solid electrolyte material; and raising the plurality of anodes away from the cathode block when a predetermined depth of molten electrolyte material has been reached.

20. A method for starting up an electrolytic cell for aluminum production, the electrolytic cell having a cathode block with an upper surface, the method comprising:

disposing contact resistance material on said upper surface of the cathode block;

lowering a plurality of anodes to abut the contact resistance material, wherein the plurality of anodes are carbonaceous anodes, and wherein anode studs project from respective upper surfaces of the plurality of anodes;

filling the electrolytic cell to a height covering an upper surface of each of the plurality of anodes with solid electrolyte material, the solid electrolyte material comprising crushed electrolytic bath material, cryolite, or mixtures thereof, wherein filling the electrolytic cell comprises adding the solid electrolyte material to extend above the upper surfaces of the plurality of anodes such that the anode studs are at least partly buried in the solid electrolyte material when the plurality of anodes are lowered in intimate contact with the contact resistance material;

delivering electrical current to the plurality of anodes to at least partially melt the solid electrolyte material; and raising the plurality of anodes away from the cathode block when a predetermined depth of molten electrolyte material has been reached.

* * * * *